US006092735A

United States Patent [19]

Molyneux

[11] Patent Number: 6,092,735

[45] Date of Patent: Jul. 25, 2000

[54] ADJUSTABLE ANCHORAGE FOR CRANE RAILS

[76] Inventor: Godfrey Matthew Owen Molyneux, 321 Squire Cir., Pittsburgh, Pa. 15212

[21] Appl. No.: 09/009,485

[22] Filed: Jan. 20, 1998

[30] Foreign Application Priority Data

Jan. 22, 1997 [GB] United Kingdom ..... 97012330

[51] Int. Cl.[7] ..... E01B 13/00

[52] U.S. Cl. ..... 238/341; 238/338; 238/351

[58] Field of Search ..... 238/317, 331, 238/332, 338, 341, 342, 351

[56] References Cited

U.S. PATENT DOCUMENTS

| | | | |
|---|---|---|---|
| 3,028,099 | 4/1962 | Molyneux . | |
| 3,724,754 | 4/1973 | Molyneux . | |
| 3,934,800 | 1/1976 | Molyneux | 238/341 |
| 4,353,503 | 10/1982 | Duchemin | 238/338 |
| 4,821,957 | 4/1989 | Molyneux . | |
| 4,889,282 | 12/1989 | Marchant | 238/331 |
| 4,967,955 | 11/1990 | Molyneux . | |
| 5,344,072 | 9/1994 | Molyneux | 238/341 |

*Primary Examiner*—S. Joseph Morano
*Assistant Examiner*—Robert J. McCarry, Jr.
*Attorney, Agent, or Firm*—Suzanne Kikel

[57] ABSTRACT

An adjustable rail anchorage device including a rail clip and a cam rotatable around a fixed mounting bolt for laterally moving the rail clip into anchoring position on the rail. The cam includes a passageway for the mounting bolt and a circular boss portion with an outer circular wall having a gap defined at projected wall positions where the projected perimeter of the wall approximately coincides with the projected perimeter of the passageway to transfer lateral loads from the rail to the mounting bolt. A welded platform base with a raised haunch for locating the mounting bolt can be used to transfer lateral loads from the rail to the raised haunch.

8 Claims, 7 Drawing Sheets

1U
1p
1a
1L

2a 3
3U
3f
3L
3b
3p
3a 3u
3L
3
3p
3b
4a 5a
6

6
5a
6a
6b 5a
7c
6b 7c
6

8c
8b
8d
3
3f
6
8s
3L
8a
3b
3a
6a
6b
8r 8a
8c
3
6
8s
8b
3b
6a 6
8r
8c
8b
8a 9a
8c
9/1a
6

10
10b
10a
10p
10U
10x
10L 10
11b
11a
10w
10x
10p

14

14
13b
13a 14
13b
14a
14c 15a
10b
10a
13a
8r
15c
15b
15d
10
14
10L
8s

15/1c
15/1b
15/1a 8r
15d
15b
15c
14
10

B/2a
8a
B/2a
6
4b
7c

B/1a
8a
8c
B/1a
6
8r 8c
8b
8d
3f
3a
6
3L
8s
8a
3
6a
8r 4b
8c
3
6
7c
8r 8a
8c
6
7c
3
4b 8c
8e
8a
6
3
7c
8r 25
25a
25b 25
26a
25b
26c 25
26a
27b 21a
21l
21u
20b
20a
20c 20b
20a
21a
21c
21L
21U

24

22

23

17
17a
17b
17c 17b
17a
17c 17b
17
19a
17c 24
17a
20b
25b
20
25
8r
17

27a
17a
25b
24
25

8r
25
23
22
24
21
17
8s

ADJUSTABLE ANCHORAGE FOR CRANE RAILS

This invention relates to rail anchorages or rail clips which are used with all rails and is particularly concerned with rail clips for use with rails used by cranes.

BACKGROUND OF THE INVENTION

Reference may be made to my prior U.S. Pat. Nos: 5,344,072; 4,967,955; 4,821,957; and to my prior U.S. patents cited as references in the aforementioned patents.

Adjustable rail anchorages are subject to very large lateral loads applied to the rails, particularly in crane rails by cranes as they travel along the rails, being cranes used for material handling in industrial facilities. Such cranes travel along rails which are supported generally on steel structures, the rails being maintained in the required position by rail anchorages that have to ensure that the rails remain located when very substantial lateral loads are generated, for example, when the crane is in motion. It is therefore important that the rails properly guide the cranes by being correctly aligned. Poorly aligned rails result in crane wheel wear and wear to the sides of the rail head and cause the crane to skew and bind against the rail. As a consequence even larger lateral forces can be generated on to the rail as the crane skews and binds. By providing an anchorage that is laterally adjustable the lateral alignment of the rail can be more easily established and maintained. However, when the rail anchorages offer adjustability other problems can occur. They can slip due to contamination by oil and grease which can drip from the crane axle and bearings as the crane travels along the rail. The oil and grease can lubricate the sliding surfaces of the adjustable anchorage. Also, adjustable rail anchorages are generally installed by a threaded bolt or threaded stud which requires careful attention that adequate torque is applied to the bolt or nut in order to prevent slipping of the anchorage.

Cam devices have been used in rail anchorage devices as a means of adjustment. Attempts have been made to prevent untoward cam rotation by use of incremental locking positions, which have the result that only incremental adjustments are possible. The bolt or other fastening device provided has been placed centrally within a hole in the cam. In the prior art the application of the lateral load from the rail to the clip does not increase the frictional resistance of the cam against rotation within the rail clip.

In existing adjustable rail clips that are adjusted with a cam, the cam is a relatively bulky element. Consequently, the secondary element into which the cam is installed is also relatively large. This secondary element usually contacts the rail and is called a clip body. By reducing the size of these elements, but maintaining the strength, the rail clip can be installed in situations previously impossible to install an adjustable rail clip, or the same sized rail clip can be installed but having more lateral adjustment.

FIGS. 1 & 2 represent a cam in the prior art. FIG. 1 is a side view and FIG. 2 is a plan view. The upper and lower parts of the cam are 1U and 1L respectively. The lower part of the cam 1L is a circular boss. There is an opening 1p in the upper and lower parts of the cam which is continuous. If a bolt is assembled inside this opening in the cam, the bolt is totally enclosed, in the plane perpendicular to the length of the bolt, by the opening in both the lower and upper parts of the cam. The walls of the opening encompass the bolt including at positions 1*a* and 2*a*, which is the narrowest part of the circular boss 1*a*.

It is desired to provide a smaller, more efficient, adjustable rail clip in plan view or bird's eye view, yet still have the same strength to resist lateral forces applied by the rail to the rail clip.

SUMMARY OF THE INVENTION

In accordance with the principles of the present invention there is provided an adjustable rail anchorage device including, a support surface for supporting a rail, and a bolt, welded stud and/or other fixing element connected to the support surface. The bolt or welded stud is generally threaded and is combined with a washer and threaded nut. A rail clip body is provided with an opening to receive a cam. A cam rests on a surface of the clip body in order to position the cam in the vertical plane relative to the clip body and having a part with circular outer sides which are designed to engage with the sides of an opening in the clip body. The cam rotates within the clip body in the horizontal plane.

The cam has a vertical opening which provides for the passage of a bolt, welded stud or other fixing element. The center of the opening in the cam is off set from the center of the circular outer sides. The opening in the cam does not always encompass the bolt, welded stud or other fixing element. There is a gap in the wall of the opening where the projected perimeter of the circular outer sides of the cam which engage with an opening in the clip body, and the projected perimeter of the opening in the cam approximately coincide. This allows the plan area of the cam to be smaller and consequently the plan area of the clip body to be smaller than such prior art devices. In prior art devices there is no gap in the walls of the opening and the bolt shaft is always enclosed in the horizontal plane by the walls of the opening. In contrast, in the invention the gap in the wall of opening of the cam allows the bolt, stud or other fixing element to be positioned very close to or against the sides of the opening in the clip body.

In one embodiment of the invention, a threaded bolt is positioned through a hole in a support surface, a threaded stud is welded to the support surface or other fixing element is installed on the support surface. A clip body is positioned over the bolt, welded stud or fixing element so that the bolt, welded stud or fixing element passes up through a hole in the clip body. The clip body rests on the support surface and against the rail. The cam is passed down over the bolt, stud or fixing element, with the bolt stud or fixing element passing through an opening in the cam, and a circular part of the cam is assembled into the hole in the clip body. Because the center of the opening in the cam is eccentric to the center of the circular part of the cam which rotates inside the hole in the clip body, the position of the bolt, stud or fixing element relative to the center of the clip body hole is also eccentric. Consequently, by rotating the cam in the horizontal plane, the circular part of the cam engages with the hole in the clip body and the clip body moves laterally relative to the bolt, stud or fixing element, relative to the support surface and relative to the rail. A gap in the walls of the opening of the circular part of the cam allows the bolt, stud or fixing element to be positioned close to or against the sides of the hole in the clip body, so that the lateral load from the rail to the clip body may be transferred to the bolt, stud or fixing element, from the cam, from the clip body and cam combined or directly from the clip body.

In prior art devices, discounting the effects of friction on the surfaces of the parts of the complete assembled elements, the lateral load from the rail is always transferred by the cam to the bolt, stud or fixing element. When a nut and washer are assembled onto the bolt and the nut tightened against the washer, this squeezes the washer onto the cam, and the cam onto the clip body, and the clip body onto the support surface. Consequently, the cam is prevented from rotating within the clip body and the position of the clip body relative to the support surface, relative to the bolt, stud or fixing element and relative to the rail is fixed. There is a similar rail clip assembly on the other side of the rail, so that when the cams of each are rotated the lateral position of the rail can be adjusted and maintained in position.

Another embodiment of the invention reduces the bending moment of the lateral load being transferred to the bolt, stud or fixing element. This is achieved by lowering the contact point of the cam on the bolt, stud or fixing element and where applicable lowering the contact point of the clip body on the bolt, stud or fixing element.

In another embodiment of the invention there is a base welded to the support surface and a bolt installed in the base. The base has a pocket into which the bolt head is installed and has a raised haunch area into which the shaft of a bolt is installed and which captures the front of the bolt, that is the part of the bolt closest to the rail. A clip body with a hole to accept a cam, and then a cam are lowered over the bolt and the raised haunch. The cam has an opening to accept the bolt and the raised haunch. The cam has a lower part which is a circular boss where the center of the opening is eccentric to the center of the boss and with a gap in the walls of the opening where the projected perimeter of the circular boss and the projected perimeter of the opening in the lower part of the cam approximately coincide.

The surfaces of the opening in the cam and/or the hole in the clip body are designed to bear against the front area of the raised haunch of the base, that is the outer surface of the raised haunch closest to the rail. By rotating the cam, the clip body will move laterally relative to the bolt and the base. Consequently, the clip body can be positioned laterally against the rail and the lateral position of the rail can be adjusted. When a nut and washer are assembled onto the bolt and the nut tightened against the washer, this squeezes the washer onto the cam, and the cam onto the clip body, and the clip body onto the base. Consequently, the cam is prevented from rotating within the hole in the clip body and the position of the clip body, relative to the base and relative to the rail, is fixed.

In one particular embodiment of the invention, prior to tightening the nut, the cam can be rotated within the clip body so that the majority of lateral load from the rail can be transferred by bearing, directly from the clip body to the front of the raised haunch of the base. Alternatively, the cam can be rotated to a position so that the lateral load is transferred from the clip body through the cam and then to the front of the raised haunch of the welded base. Alternatively, the cam can be rotated where both the cam and the clip body share in transferring the lateral load to the front of the raised haunch of the base. The proportion of the lateral load transferred through the cam or through the clip body depends upon the rotated position of the cam.

BRIEF DESCRIPTION OF THE DRAWINGS

The features of this invention which are believed to be novel are set forth with particularity in the appended claims. The invention may be best understood by reference to the following description taken in conjunction with the accompanying drawings, in which:

DETAILED DESCRIPTION

Figures 1, 2, 3, 4, 5, 6, 7, 7A, 8, 8A, 9, 9A:
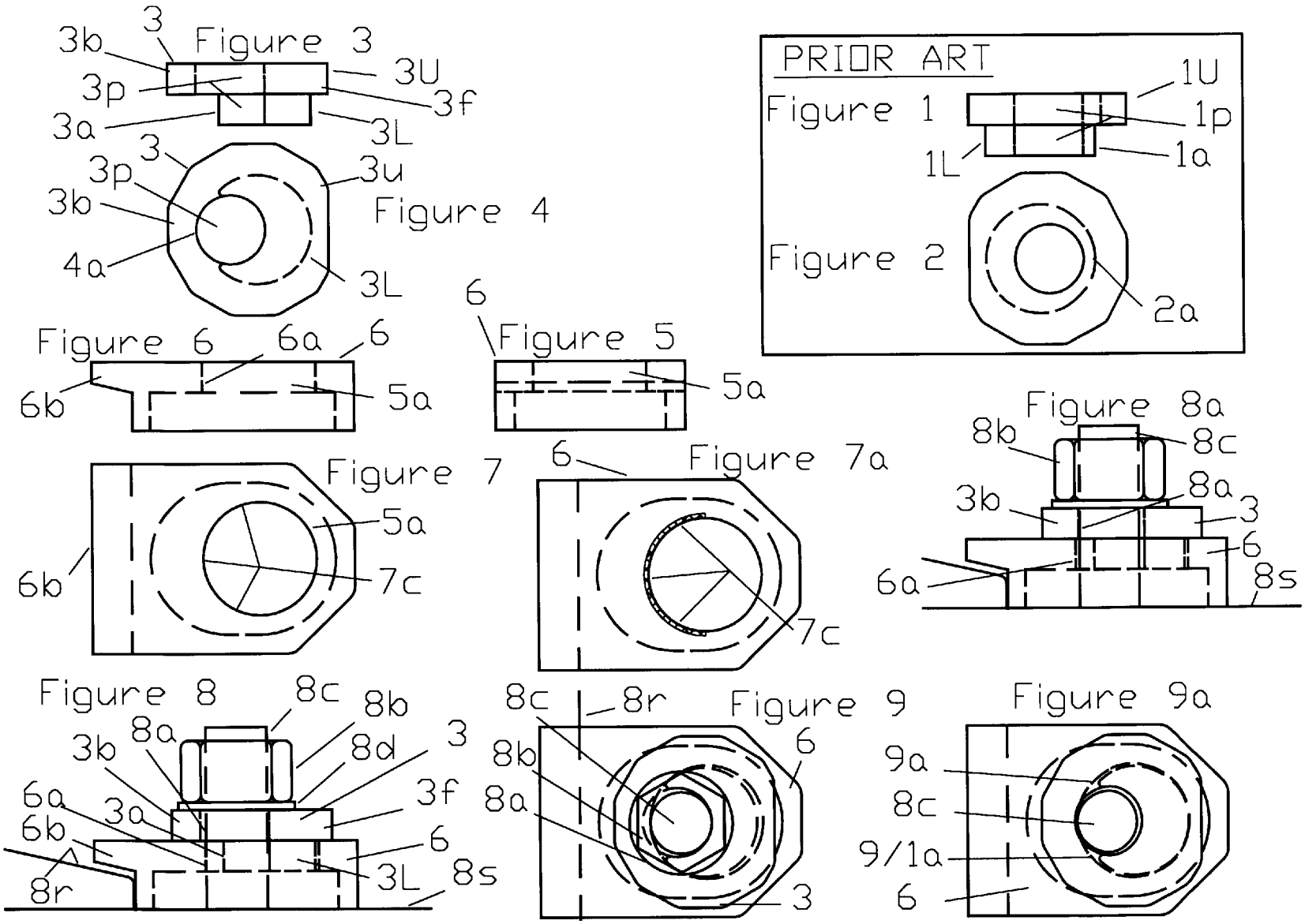
PRIOR ART Figure 1
FIG. 1 is a side view of a prior art cam element used in an adjustable anchorage for crane rails.
FIG. 2 is a plan view of the prior art cam element of FIG. 1.
FIG. 3 is a side view of a cam element used in an adjustable anchorage for crane rails in accordance with the present invention.
FIG. 4 is a plan view of the cam element of FIG. 3.
FIG. 5 is an end elevational view of a clip body used with the cam element of FIG. 3.
FIG. 6 is a side elevational view of the clip body of FIG. 5.
FIG. 7 is a plan view of the clip body of FIG. 5.
FIG. 7*a* is a plan view of the clip body of FIG. 5 with added cross hatching to indicate a potential front bearing area.
FIG. 8 is a side view of an assembled adjustable rail anchorage device according to the invention.
FIG. 9 is a plan view of the rail anchorage device of FIG. 8.
FIG. 9*a* is a plan view of the rail anchorage device of FIG. 8 with the nut and washer removed for convenience of illustration.
FIG. 8*a* is a side elevational view of an adjustable rail anchorage device in accordance with another embodiment of the invention.

FIG. 3 is a side view of the cam element of the invention. FIG. 4 is a plan view of the cam element 3 of the invention. 3U is the upper part of the cam and 3L is the circular boss at the lower part of the cam. 3*f* is a flange of the upper part of the cam. There is an opening 3*p* in the upper and lower parts of the cam. The opening 3P is continuous through the cam. The center of the opening 3P in the lower part of the cam is eccentric to the center of the circular boss 3L. The walls of the opening 3P are open at position 3*a* and 4*a*. This is where the projected perimeter of the circular boss 3L and the projected perimeter of the opening in the lower part of the cam approximately coincide. This is in the area where the sides of the circular boss 3L become the narrowest. 3*b* is the narrowest part of the upper part of the cam 3U in relation to the opening 3*p* and the outside perimeter of the upper part of the cam.

FIG. 5 is an end view of the clip body 6, where 5*a* is a circular hole which receives a cam. FIG. 6 is a side view of the clip body where 5*a* is a circular hole to receive a cam, 6*a* is the front area of the hole in the clip body and 6*b* is the part of the clip that overhangs the rail flange. FIG. 7 is a plan view of the clip body, where 6*a* is a hole in the clip body, 7*c* is the front area of the hole and 6*b* is the part of the clip body that overhangs the rail flange. The front area of the hole in the clip body is the surface that is contacted by the circular boss of the cam or the bolt, stud or fixing element, where these parts of the invention are forced against the front surfaces of the hole in the clip body when lateral load is applied from the rail to the rail clip. Depending upon the fit of the circular boss of the cam with the circular hole in the clip body, this front area 7*c* may be almost the front half of the hole in the clip body. That is the half of the perimeter of the hole in the clip body that is closest to the rail. This is shown in FIG. 7*a* where the potential front bearing are 7/1*c* is marked with hatching.

FIG. 8 shows the invention assembled with the boss 3L of the cam installed in the hole 5*a* in clip body 6. The flanges 3*f* of the cam 3 rest on the clip body 6. The clip body is installed against the flange of a rail 8*r*. The clip body 6 and rail flange 8*r* rest on a support surface 8*s*. A threaded bolt 8*c* passes through a hole in the support surface 8*s* and through the hole 5*a* in the clip body 6 and the opening 3*p* in cam 3. The bolt could also be a threaded stud which is welded to the support surface 8*s*. In the figure the cam 3 has been rotated so that the opening 3*p* or gap in the boss 3L faces, that is opens, towards the rail 8*r*, which allows the front part 8*a* of the bolt shaft to resist lateral forces from the rail by bearing against the front area of the hole in the clip body at 6*a*, i.e., at front bearing area 7*c*. The invention is designed in this particular embodiment so when the cam is rotated in this position large lateral forces are not significantly transferred to the weak area 3*b* of the cam 3.

In this embodiment of the invention there is either incidental contact or no contact between the front 8*a* of the bolt shaft and the cam flange at 3*b*. When the cam is in this position the circular boss of the cam acts as a guidance means for the bolt, stud or fixing element to guide it to this position. When the bolt, stud or fixing element is in this position, since the lateral load is transferred directly from the clip body to the bolt, stud or fixing element, the boss part of the cam may not bear against the front of the hole in the clip body since it is not involved with the transfer of lateral forces from the rail, except for part of the lateral load that is transferred to the cam by surface friction after a nut has been assembled on the invention and tightened on the bolt or welded stud, as described later in this description.

FIG. 9 is a plan view of FIG. 8 where 6 is the clip body, 3 is the cam, 8*d* is the washer, 8*b* is the nut, 8*c* is the bolt or stud and 8*r* is the rail.

FIG. 9*a*, is a plan view, where the nut and washer have been removed for clarity, and showing no contact of the boss 3L of the cam with the front area 9*a* of the hole in the clip body. Lateral forces are transferred from the clip body 6 directly to the bolt or welded stud 8*c*.

In another embodiment of the invention where lateral forces are small the lateral load can be transferred to the cam at 3*b* and there may be equal contact of the bolt/stud/fixed element with the cam and clip body or contact only with the cam. This can be seen in FIG. 8*a* where the front of the bolt shaft 8*a* does not quite touch the front area 6*a* of the hole in the clip body 6 because contact is made with the flanged area of the cam at 3*b*. With reference to FIG. 8*a*, under these circumstances where load is transferred via the cam at 3*b* the boss of the cam will engage with the surfaces of the front of the hole in the clip body and receive lateral load from the clip body. Contact may ultimately be made by the front of the bolt shaft 8*a* with the front area of the hole in the clip body at 6*a*, if lateral loads from the rail are large enough to cause the bolt 8*c* to locally deform the flange of the cam at 3*b*. In both FIGS. 8 and 8/1 before the washer 8*d* and nut 8*b* are assembled on the bolt and the nut tightened, the cam 3 can be rotated in clip body 6, so as to adjust the lateral position of the clip body 6 relative to the bolt or stud 8*c*, relative to the support surface 8*s* and relative to the rail 8*r*, so the lateral position of the rail 8*r* can be adjusted. Once the nut 8*b* is tightened on the bolt 8*c* this compresses the washer 8*d* against the cam 3, which is compressed against the clip body 6, which is compressed against the support surface 8*s*, so the cam will not rotate, even when large lateral loads are applied to the rail clip.

Figures 10, 11, 12, 13, 14, 15, 15A, 16:
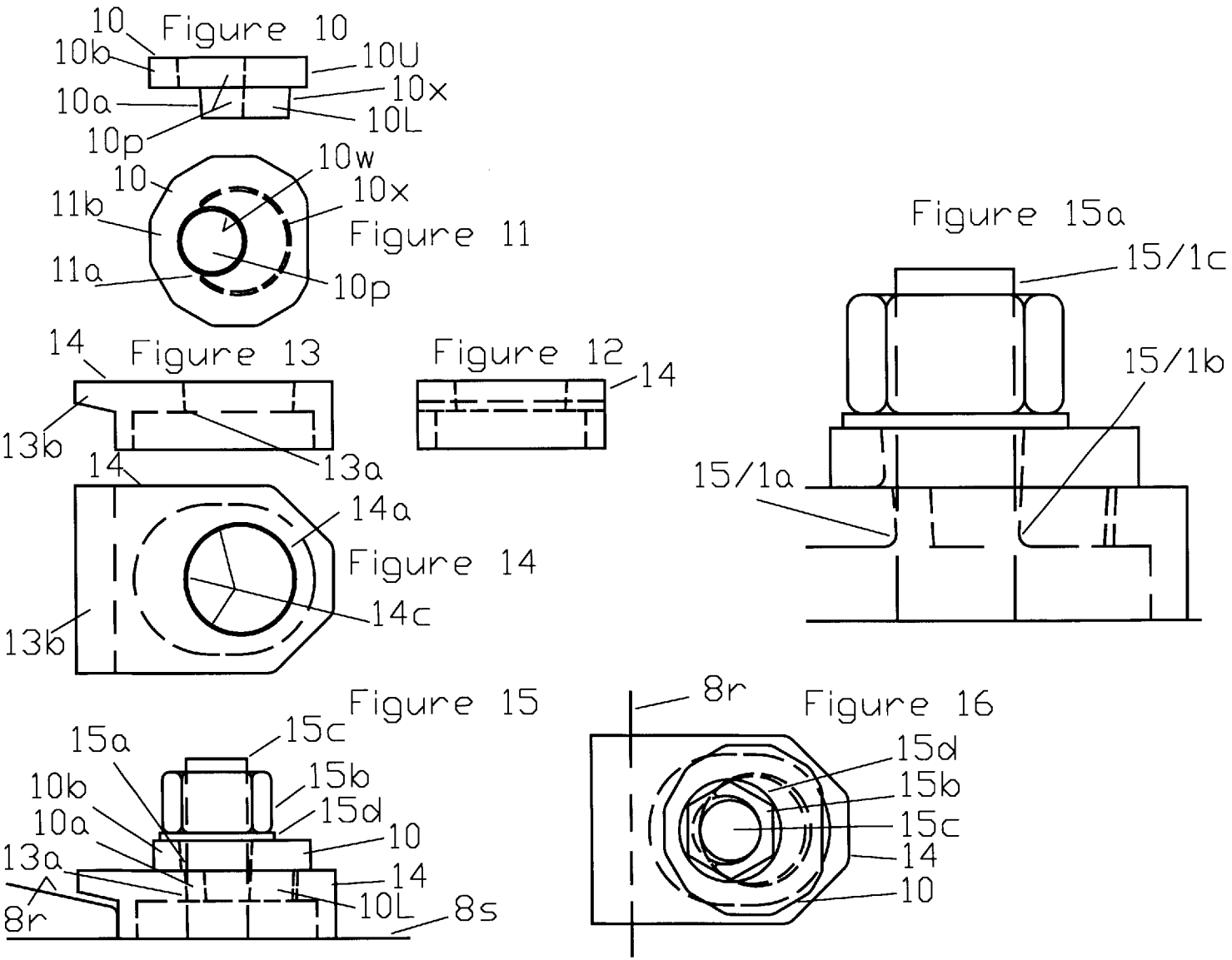
FIG. 10 is a side view of an alternative cam embodiment of the present invention.
FIG. 11 is a plan view of the cam element of FIG. 10.
FIG. 12 is an end elevational view of a clip body to be used with the cam element embodiment of FIG. 10 in an adjustable rail anchorage device according to the invention.
FIG. 13 is a side view of the clip body of FIG. 12.
FIG. 14 is a plan view of the clip body of FIG. 12.
FIG. 15 is a side view of an assembled adjustable rail anchorage device using the cam of FIG. 10 and a clip body of FIG. 12.
FIG. 16 is a plan view of the assembled rail anchorage device of FIG. 15.
FIG. 15*a* is a side view of an assembled adjustable rail anchorage device in accordance with an alternative embodiment of the invention.

FIGS. 10 through 16 show an amendment to the invention where the lateral load from the rail is transferred lower on the bolt, welded stud or fixing element. FIG. 10 is a side view of the cam 10 and FIG. 11 is a plan view, where 10U is the upper part of the cam, 10L is a circular boss at the lower part of the cam and 10*p* is a continuous opening in the cam. 10*b* is the narrowest part of the upper part of the cain 10U in relation to the opening 10*p* and the outside perimeter of the upper part of the cam. There is a gap in the walls of the opening 10*p* in the circular boss or lower part of the cam 10L at positions 10*a* and 11*a* where the projected perimeter of the circular boss and the projected perimeter of the opening in the lower part of the cam approximately coincide. The inner walls 10*w* of the opening 10*p* in the cam slope inwards towards the lowest part of the cam, so that the radius of the opening is smaller lower down the opening. Similarly the outer walls 10*x* of the lower part of the cam 10L also slope towards the center so that the small radius is lower down on the cam. FIG. 12 is an end view of the clip body. FIG. 13 is a side view of the clip body 14, where 13*a* is the front part of the hole at its smallest radius lower down in the clip body, closer to the support surface. 13*b* is the part of the clip body that overhangs the rail flange. FIG. 14 is a plan view of the clip body where 14*a* is the hole in the clip body which receives the cam, 13*b* is the part of the clip body that overhangs the rail and 14*c* is the front area of the hole which transfers lateral load to the bolt or stud, or to the boss of the cam. FIG. 15 shows the invention assembled with the clip body 14 resting on the support surface 8*s*.

The clip body is positioned against the rail flange 8*r*. The circular boss 10L of the cam 10 is positioned inside the hole in clip body 14. Threaded bolt 15*c* is positioned through a hole in the support surface 8*s*, or threaded welded stud 15*c* is welded to the support surface 8*s* and passes up through the hole in the clip body 14 and through the opening in cam 10. A washer 15*d* is placed over the bolt or stud with a threaded nut 15*b* tightened down so that it compresses against the washer.

In FIG. 15 the contact of the front of the bolt or stud 15*a* is lower in the clip body hole at 13*a*. The amendment to the design provides a lower contact point of the clip body and/or cam on the front of the bolt shaft 15*a*. This reduces the bending moment applied to the bolt by the lateral load from the rail. FIG. 16 is a plan view of FIG. 15 where 16*a* is the rail, 14 is the clip body, 10 is the cam, 15*d* is the washer, 15*b* is the nut and 15*c* is the bolt or welded stud.

FIG. 15*a* is an additional amendment where at the point of contact with the stud or bolt 15/1*c*, the front of the hole in the clip body and/or the cam can correspond to the bolt surface to which it is transferring load by an increase in the contact or bearing area. This is seen at positions 15/1*a* and 15/1*b* where contact areas have been increased by a radius and can also be increased by flattening out mating areas were lateral load is transferred. This is particularly important where larger lateral loads are involved in order to reduce bearing stresses in the contacting surfaces.

Figures 15B, 15C, 15D, 15E, 15F, 15G:
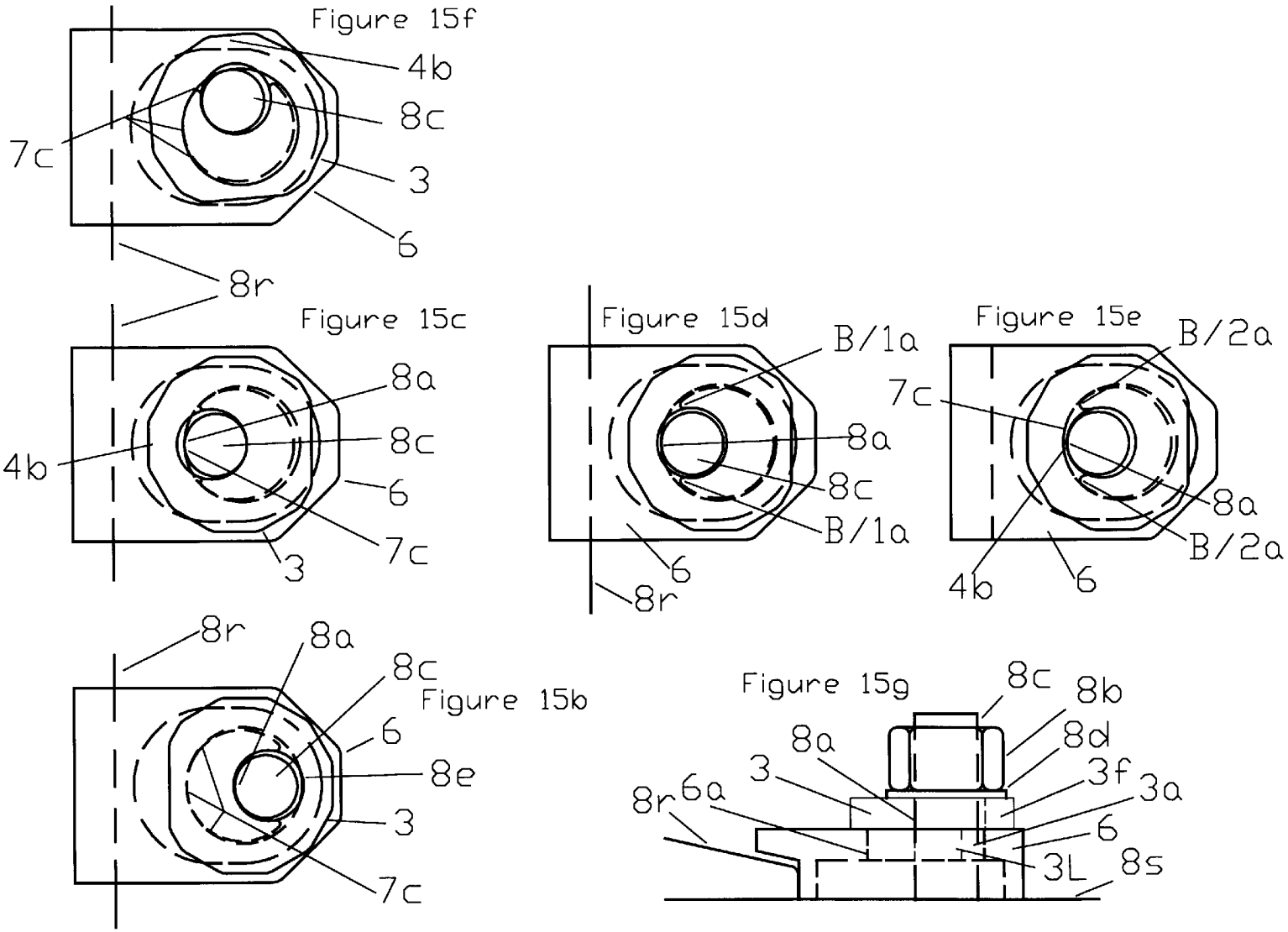
FIGS. 15*b*, 15*c*, 15*d*, 15*e* and 15*f* are plan views of an adjustable rail anchorage device according to the invention in different rotated positions of the cam and with the washer and nut omitted for convenience of illustration.
FIG. 15*g* is a side view of the adjustable rail anchorage device of FIG. 15*b* with the washer and nut included.

FIGS. 15*b*, 15*c*, 15*d*, 15*e* and 15*f* are plan views of the invention showing different rotated positions of the cam 3 in the hole in clip body 6. Each figure includes a plan view of the bolt or stud shaft 8*c* installed with the invention. The washer and nut have been omitted for clarity. Various contact positions of the front 8*a* of the bolt shaft 8*c* with the cam 3 and the clip body 6 are illustrated in these three figures when substantial lateral forces are applied from the rail 8*r* to the clip body. In FIG. 15*b* the cam 3 is rotated so that the contact with the front 8*a* of the bolt shaft 8*c* occurs only on the inner walls of the opening in cam 3. Lateral forces from the rail 8*r* are consequently transferred to the clip body 6 and then to the cam 3 at area 7*c* of the front of the hole in the clip body, before they are transferred to the bolt shaft.

FIG. 15*g* is a side view of FIG. 15*b*, but the washer 8*d* and nut 8*b* are included. The flange 3*f* of the cam rests on the clip body. The front 8*a* of the bolt or stud is bearing against the sides of the opening in the cam 3. The boss 3L of the cam 3 is bearing against the front area 7*c* of the hole 5*a* in the clip body 6. The clip body 6 is positioned against the rail 8*r*.

In FIG. 15*c* the front 8*a* of the bolt shaft bears against the front area 7*c* of the hole 5*a* in the clip body 6. In FIG. 15*f* the cam 3 is rotated to the intermediate position where the bolt shaft 8*c* bears against both the inner sides of the cam opening and the sides of the hole in the clip body. The proportion of the bearing of the bolt or stud on the cam and the bolt on the front area 7*c* of the hole 5*a* in the clip body, to transfer the lateral load from the rail, varies depending upon the rotated position of the cam.

In FIGS. 15*b*, 15*c*, 15*d*, 15*e* and 15*f* there is a slight tolerance gap shown between the outer sides of the circular boss or lower part of the cam and the sides of the hole in the clip body. This gap allows the circular boss 3L of the cam to be installed in the hole 3*p* in the clip body 6. There is also a tolerance gap between the bolt shaft 8*c* and the opening 3*p* in the cam 3 which allows assembly of the bolt within the opening of the cam. After the nut 8*b* has been tightened on the bolt or stud, with the clip assembly compressed onto the support surface, when large lateral forces are received from the rail by the clip body, which overcome any friction between the clip body and the support surface, and the cam and the clip body, relative movement will occur between these elements until all these gaps are behind the bolt shaft and bearing occurs on the front of the bolt shaft with, no gaps between the front of the shaft 8*a*, any of the elements of the rail clip and the rail flange where it bears against the clip body. For example, in FIG. 15*b*, the tolerance gaps to the rear of the bolt or stud 8*c* are shown at position 8*e*. This is the condition shown in FIGS. 15*b*, 15*e* and 15*f*.

With reference to FIG. 15*c*, if load however is transferred directly from the clip body 6 to the bolt, stud or fixing element 8*c*, then there may be a space between the front surfaces of the hole in the clip body and outer surfaces of the boss of the cam that engage with the hole in the clip body at area B/1*a*, even with the application of large lateral loads from the rail. This is because the cam is bypassed in transferring the lateral load from the rail to the bolt, stud or fixing element. However, there is no gap between the front of the bolt 8*a*, the clip body 6 and rail 8*r*. FIG. 15*e* shows an alternative to the invention where in the case of smaller lateral loads, the lateral loads from the rail may be transferred from the clip body 6, to the areas of the cam boss 3L in contact with the front part of the hole in the clip body at area B/2*a*, then to the cam flange at position 4*b* and then to the front 8*a* of the bolt. In this example there is a gap between the front 8*a* of the bolt or stud and the front of the hole in the clip body at area 7*c*. FIG. 15*g* shows a side view of this embodiment of the invention except a nut and washer have been added.

Figures 17, 18, 19, 20, 21, 22, 23, 24, 25, 26, 27:
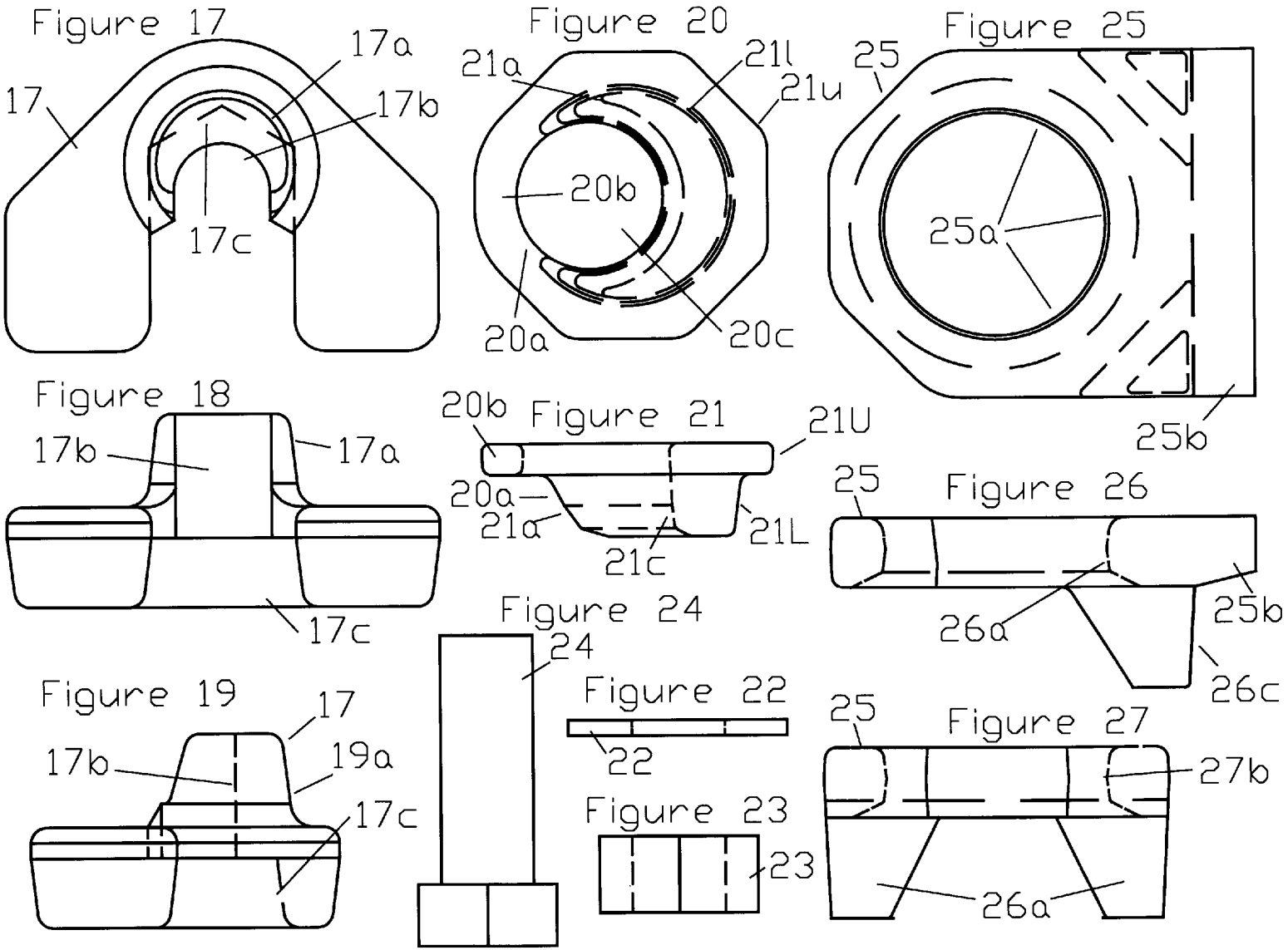
FIG. 17 is a plan view illustrating a welded platform base used in an alternative adjustable rail anchorage device.
FIG. 18 is an end view of the welded platform base of FIG. 17.
FIG. 19 is a side view of the welded platform base of FIG. 17.
FIG. 20 is a plan view of a cam element to be used with the welded platform base of FIG. 17.
FIG. 21 is a side view of the cam element of FIG. 20.
FIG. 22 is a side view of a washer.
FIG. 23 is a side view of a threaded nut.
FIG. 24 is a side view of a threaded bolt.
FIG. 25 is a plan view of a clip body to be used with the welded platform base of FIG. 17, cam element of FIG. 20, and the washer, threaded nut and bolt of FIGS. 22-24.
FIG. 26 is a side view of the clip body of FIG. 25.
FIG. 27 is an end view of the clip body of FIG. 25.

In another embodiment of the invention, instead of a bolt passing through a hole in the clip body, a raised haunch on a welded platform base, with a bolt assembled inside, passes through the hole in the clip body and the opening in the cam. The raised haunch combined with the bolt replace the bolt/welded stud in the previous embodiment of the invention. The illustrations regarding the positions of the cam relative to the clip body and the bolt or stud shown in FIGS. 15, 15*c*, 15*d*, 15*e* and 15*f* are relevant to this embodiment of the invention. FIG. 17 is a plan view of a welded platform base 17, where 17*a* is a raised haunch on the base and 17*b* is a bolt passageway and 17*c* is a pocket to receive a bolt head. FIG. 18 is an end view of the welded platform base, where 17*a* is the raised haunch on the base, 17*b* is the bolt passageway and 17*c* is the bolt head pocket. FIG. 19 is a side view of the welded platform base, where 19*a* is the front area of the raised haunch 17*a* that receives the lateral load from the cam or the clip body, 17*b* is the bolt passageway and 17*c* is the pocket to receive a bolt head.

FIG. 20 is a plan view of a cam 20 where 20*a* is the gap in the boss of the cam where the projected perimeter of the circular boss and the projected perimeter of the opening in the lower part of the cam approximately coincide. 20*b* is the narrowest part of the upper part of the cam in relation to the opening and the outside perimeter of the upper part of the cam. 20*c* is the opening in the cam.

FIG. 21 is a side view of the cam, where 21U is the upper flange part of the cam and 21L is the circular boss or lower part of the cam with a gap in the wall forming the boss 21L. 20*a* is the gap in the boss of the cam where the projected perimeter of the circular boss and the projected perimeter of the opening in the lower part of the cam approximately coincide. The wall 21*a* forming the boss 21L slopes inwardly away from the gap 20*a* as shown in FIGS. 20 and 21. 20*b* is the narrowest part of the upper part of the cam relative to the opening in the cam and the perimeter of the upper part of the cam. 21*c* is the surface of the inner wall of the opening in the cam that applies the load to the front 19*a* of the raised haunch 17. The center of the opening in the lower part of the cam is eccentric to the center of the circular boss.

FIG. 22 is a side view of a washer 22. FIG. 23 is a side view of a threaded nut 23. FIG. 24 is a side view of a threaded bolt.

FIG. 25 is a plan view of a clip body 25, where 25*a* is the front area of a hole in the clip body and 25*b* is the part of the clip body that overhangs a rail flange. FIG. 26 is a side view of the clip body 25, where 26*a* is the front area of the hole in the clip body which apples the load to the cam and/or to the raised haunch of the welded platform base. 26*c* is the leg of the clip body which receive the lateral load from the rail. FIG. 27 is an end view of the clip body, where 26*c* are the legs of the clip body that receive the lateral load from the rail and 27*b* is the hole that receives the boss of the cam.

Figure 28:
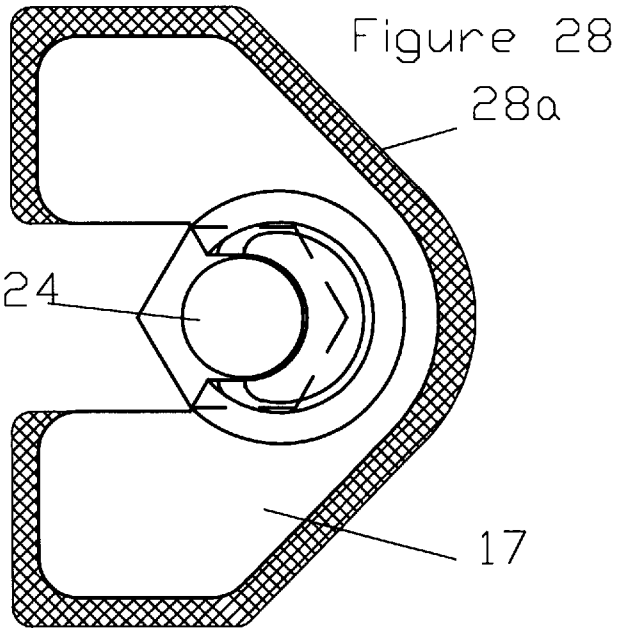
FIG. 28 is a plan view of the welded platform base of FIG. 17 welded to a support surface.
Figure 29:
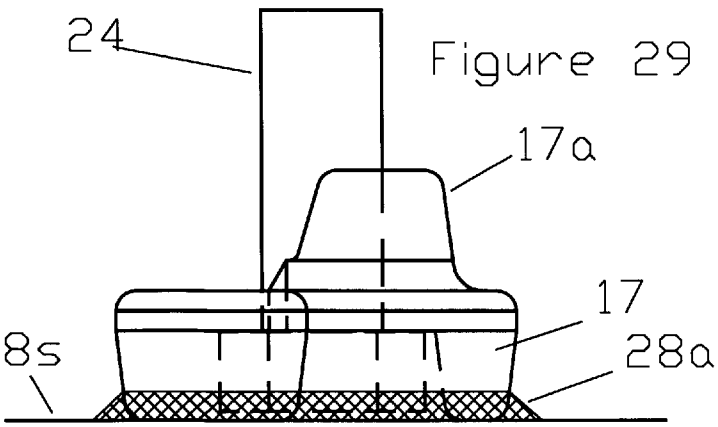
FIG. 29 is a side view of the welded platform base of FIG. 28.

FIG. 28 is a plan view of the welded platform base, where 28*a* is a weld that fixes the base to the support surface and 24 is a bolt installed inside the base. FIG. 29 is a side view of the platform base, where the weld 28 fixes the base 17 to the support surface 8*s*.Bolt 24 is installed inside the base. The weld has been omitted from FIGS. 30 to 35 for clarity.

Figure 30:
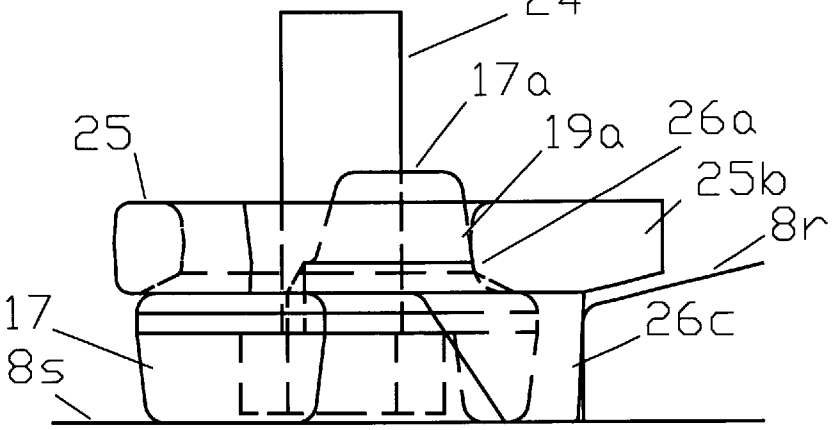
FIG. 30 is a side view of the welded platform base of FIG. 28.
Figure 31:
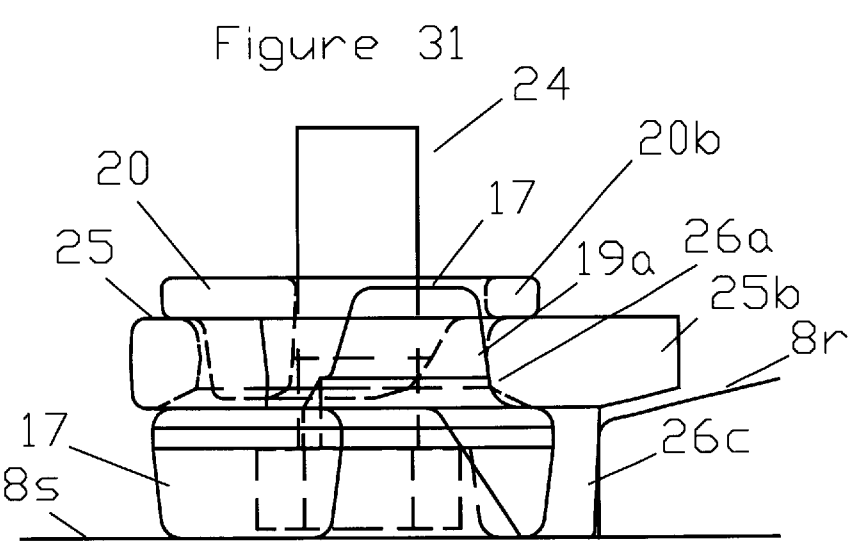
FIG. 31 is a side view of the welded platform base of FIG. 28 similar to FIG. 30 with the cam of FIG. 20 assembled in position.

FIG. 30 is a side view of the welded platform base 17, where the bolt 24 is installed in the base and the clip body 25 is installed over the bolt 24 and the raised haunch 17*a* of the base and the clip body also rests on the base 17. The legs 26*c* of the clip body 25 abut the rail 8*r*. The front area of the hole in the clip body 25 is installed against the front area 19*a* of the raised haunch 17. FIG. 31 is a view identical to FIG. 30 except the cam 21 has been installed over the bolt 24 and raised haunch 18*a*. The front area of the hole in the clip body at 26*a* bears against the front area of the raised haunch at 19*a*. The cam is rotated so that the gap in the boss of the cam faces forward and opens towards the rail 8*r*. This allows the front area of the hole in the clip body at 26*a*, to bear against the front area 19*a* of the haunch on the welded platform base. The area of the upper part of the cam, where the distance between the outer perimeter of the cam and the opening in the cam is at its narrowest 20*b*, is closest to the rail 8*r*, and there is a gap between the front 19*a* of the-raised haunch and 20*b* of the upper part of the cam, to ensure that the lateral load from the rail is transferred by bearing from the front of the hole in the clip body at 26*a* to the front of the raised haunch on the base at 19*a* without passing through the cam 20*b* or any other parts of the cam, discounting friction between the various parts of the invention when fully assembled.

In this embodiment of the invention there may be incidental contact between the front 19*a* of the raised haunch and the cam flange at 20*b*. The cam can also be rotated to the intermediate position where both the cam and the clip position where the lateral load from the rail 8*r* is transferred from the clip body, to the boss of the cam and to the front of the raised haunch of the base via the inner surfaces of the opening in the cam. Because the base is welded to the support surface 8*s*, by rotating the cam, the clip body moves laterally relative to the welded base, the support surface and the rail. This allows the lateral position of the rail to be adjusted when complimented with another adjustable rail clip on the other, opposing side of the rail.

In another embodiment of the invention lateral loads may be equally transferred by the cam at 20*b* and by the front of the hole at 26*a*, to the front 19*a* of the raised haunch. In another embodiment of the invention where there are light lateral loads, lateral loads from the rail may be transferred from the clip body, to the areas of the boss of the cam in contact with the sides of the hole in the clip body in area 26*a* and to the cam at 20*b* and then to the front of the raised haunch of the base.

Figures 32, 33, 34:
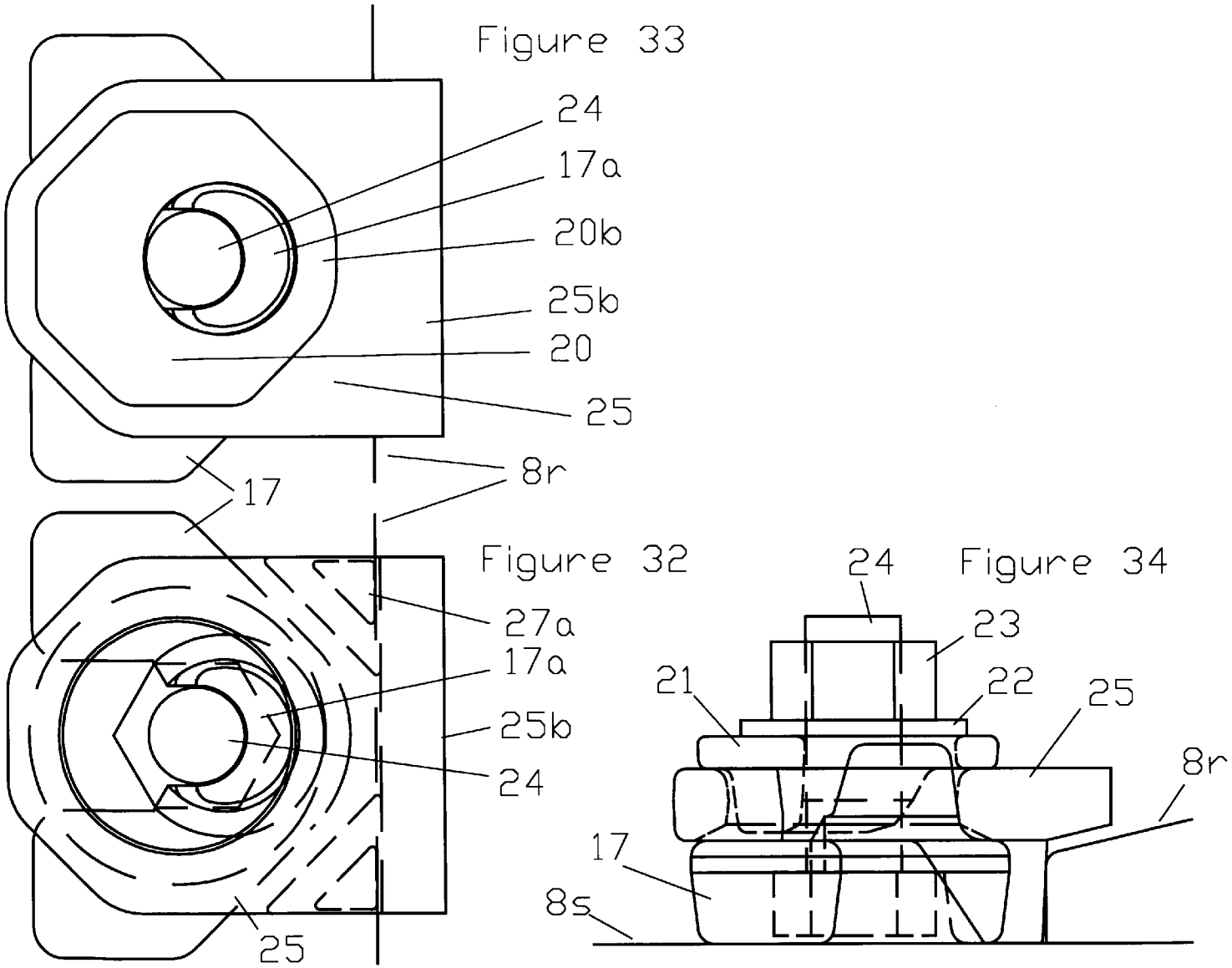
FIG. 32 is a plan view of the assembly of FIG. 30.
FIG. 33 is a plan view of FIG. 31 with internal structural lines removed for convenience of illustration.
FIG. 34 is a side view of the assembly of FIG. 31.
Figure 35:
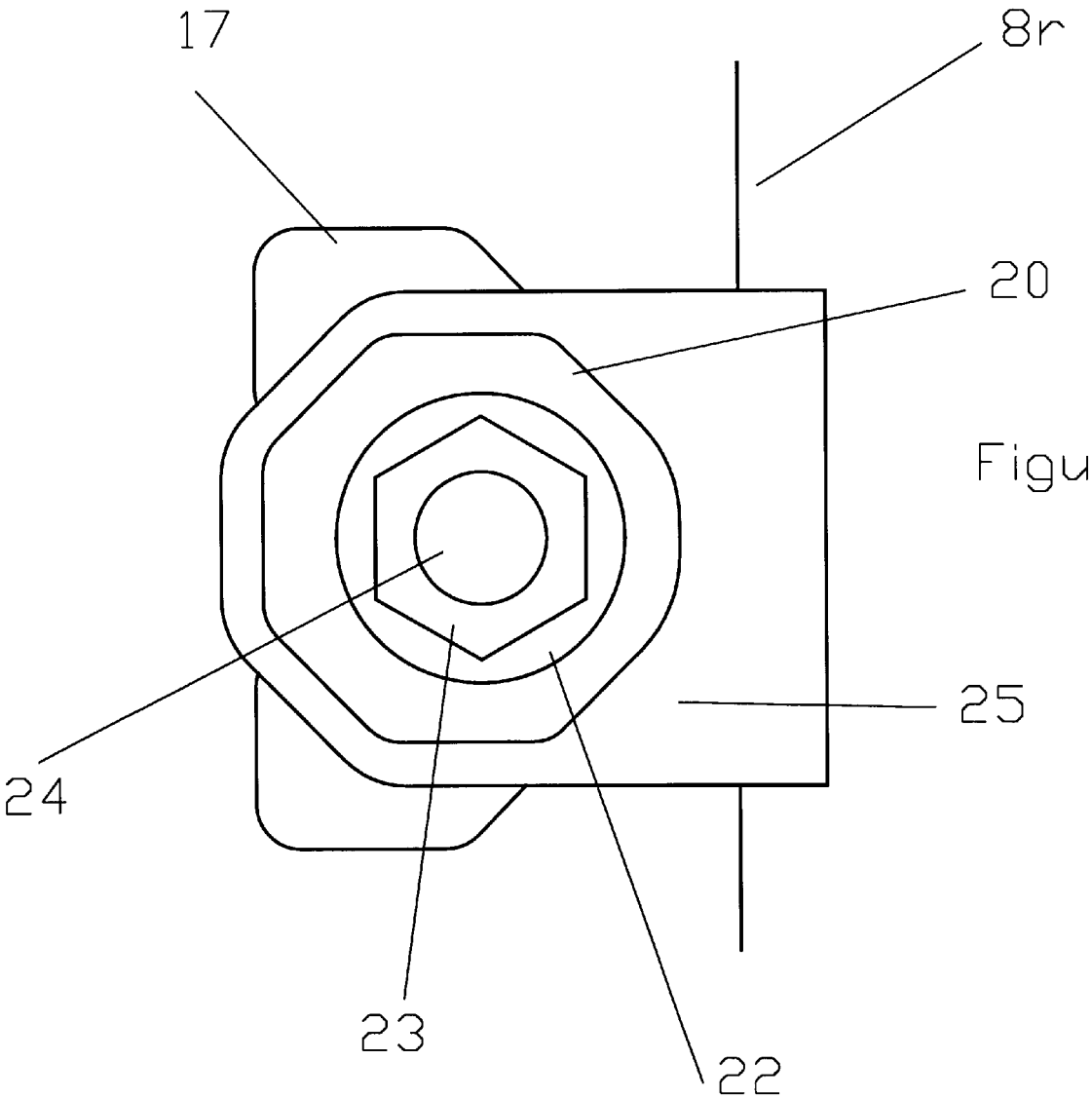
FIG. 35 is a plan view of the assembly of FIG. 34.

FIG. 32 is a plan view of FIG. 30, where bolt 24 is positioned inside base 17 and clip body 25 is assembled over the bolt 24 and raised haunch 17*a*. The clip body legs 26*c* are abutting rail 8*r*. 25*b* is the part of the clip body that overhangs the rail. FIG. 33 is a plan view of FIG. 31, with internal structural lines removed for clarity, where clip body 25 is installed on the base 17 and over bolt 24 and base haunch 17*a*, with cam 20 installed with the area of the cam 21*b* in the forward position. Rail 8*r* abuts the clip body under 25*b*, the part of the clip body that overhangs the rail. FIG. 34 is a side view as FIG. 31 except washer 22 and nut 23 are installed on the threaded bolt 24. When nut 23 is tightened it compresses washer 22 against the cam 20, which is compressed against the clip body 25, which is compressed against base 17. Base 17 is welded to support surface 8*s*. Once the nut 23 is tightened as above, the cam will not rotate within the clip body 25 and any lateral loads form the rail will be resisted without any lateral movement of the clip body. FIG. 35 is a plan view of FIG. 34 where 17 is the base, 25 is the clip body, 20 is the cam, 22 is the washer, 23 is the nut, 24 is the bolt and 8*r* is the rail.

The foregoing detailed description has been given for clearness of understanding only, and no unnecessary limitations should be understood therefrom, as modifications will be obvious to those skilled in the art.

What is claimed is:

1. An adjustable rail anchorage device supportable on a support surface for locating a rail, comprising:

a mounting member maintained fixed in position on said support surface, a rail clip coupled to said mounting member for anchoring the rail and for receiving the lateral load from said rail, said rail clip having a through opening with inner circular wall surfaces, a rotatable cam engaging said rail clip and said mounting member so that rotation of said cam around said mounting member enables lateral movement of said rail clip, said cam being maintained in position with thread locking means engaging said mounting member, said rotatable cam having an upper flange portion mounted adjacent said rail clip, a lower circular boss portion engaged in said opening in said rail clip and a passageway extending through said upper flange portion and through said lower circular boss portion for passage of said mounting member in said cam, said lower circular boss portion of said rotatable cam having an outer circular wall defining said passageway extending through said lower circular boss portion of said rotatable cam; said outer circular wall of said lower circular boss portion having an opened portion where the projected perimeter of said outer circular wall approximately coincides with the projected perimeter of the passageway in said upper flange portion, the longitudinal axis through the center of the passageway being offset from the longitudinal axis through the center of the lower circular boss portion, and which said passageway extending through at least said lower circular boss portion of said rotatable cam locates said mounting member in said inner surfaces of said opening of said rail clip, and wherein said rotation of said rotatable cam around said mounting member enables said rail clip to be moved laterally relative to the rail and said opened portion of said outer circular wall of said lower circular boss portion of said cam to be rotated around said mounting member in said rail clip so that the lateral load from the rail to said rail clip is selectively transferred to the mounting member (a) by said cam, (b) by said rail clip, or (c) by both said cam and said rail clip combined.

2. An adjustable rail anchorage device according to claim 1 wherein said opened portion of said lower circular boss portion of said rotatable cam in said rail clip opening is positioned toward said rail such as to allow said mounting member to bear directly against the inner circular wall surfaces of said opening of said rail clip for said selective transfer of said lateral load from said rail clip to said mounting member (b) by said rail clip.

3. An adjustable rail anchorage device according to claim 1, wherein said rail clip includes an overhang portion for engaging the rail.

4. An adjustable rail anchorage device according to claim 1, wherein said inner circular wall surfaces of said rail clip opening are engaged at a surface area of engagement by the outer circular wall portion of said lower circular boss portion of said cam and said mounting member for said selective transfer of said lateral load from said rail clip to said mounting member (a) by said cam.

5. An adjustable rail anchorage device according to claim 4, wherein said surface area of engagement can be up to about one-half of said inner circular wall surfaces of said rail clip opening for said selective transfer of said lateral load from said rail clip to said mounting member (c) by both said cam and said rail clip combined.

6. An adjustable rail anchorage device according to claim 1, wherein said outer circular wall of said lower circular boss portion of said rotatable cam slopes inwardly away from said upper flange portion of said cam.

7. An adjustable rail anchorage device according to claim 1, wherein said passageway in said rotatable cam has a reduced diameter from said flange portion of said cam towards said lower circular boss portion of said cam in order to enable engagement of said mounting member at a lower contact point in said rail clip opening which contact point is closer to said support surface for said rail anchorage device.

8. An adjustable rail anchorage device supportable on a support surface for locating a rail, comprising a mounting member, a platform base maintained fixed in position on said support surface and including a raised haunch extending upwardly therefrom including a pocket for receiving and maintaining said mounting member fixed within said raised haunch with a portion of said mounting member extending beyond said raised haunch, a rail clip being mounted on said mounting member and said raised haunch for anchoring the rail and for receiving the lateral loads from said rail, said rail clip having a through opening with inner circular wall surfaces, a rotatable cam engaging at least said rail clip and said mounting member so that rotation of said cam around said mounting member enables lateral movement of said rail clip, said cam being maintained in position with thread locking means engaging said mounting member, said rotatable cam having an upper flange portion mounted adjacent said rail clip, a lower circular boss portion engaged in said opening in said rail clip and a passageway extending through said upper flange portion and through said lower circular boss portion for passage of said mounting member in said cam, said lower circular boss portion of said rotatable cam having an outer circular wall defining said passageway extending through said lower circular boss portion of said rotatable cam; said outer circular wall of said lower circular boss portion having an opened portion where the projected perimeter of said outer circular wall approximately coincides with the projected perimeter of the passageway in said upper flange portion, the longitudinal axis through the center of the passageway being offset from the longitudinal axis through the center of the lower circular boss portion, and which said passageway extending through at least said lower circular boss portion of said rotatable cam locates said mounting member in said inner surfaces of said opening of said rail clip, and wherein said rotation of said rotatable cam around said mounting member enables said rail clip to be moved laterally relative to the rail and said opened portion of said outer circular wall of said lower circular boss portion of said cam be selectively rotated around said mounting member and in said rail clip so that the lateral load from the rail to said rail clip is selectively transferred (a) through said haunch of said platform base by said rail clip or (b) through said haunch of said platform base by said rail clip and said cam or (c) through said haunch of said platform base by said cam.

* * * * *